US009616476B2

(12) United States Patent
Winterfeldt

(10) Patent No.: US 9,616,476 B2
(45) Date of Patent: Apr. 11, 2017

(54) DEVICE AND METHOD FOR ROLLING OF PIPE BLANKS

(75) Inventor: Thomas Winterfeldt, Rheinberg (DE)

(73) Assignee: SMS group GmbH, Duesseldorf (DE)

( * ) Notice: Subject to any disclaimer, the term of this patent is extended or adjusted under 35 U.S.C. 154(b) by 804 days.

(21) Appl. No.: 13/489,976

(22) Filed: Jun. 6, 2012

(65) Prior Publication Data

US 2012/0312062 A1 Dec. 13, 2012

(30) Foreign Application Priority Data

Jun. 7, 2011 (DE) ..... 10 2011 116 666

(51) Int. Cl.

| | |
|---|---|
| ***B21B 19/06*** | (2006.01) |
| ***B21B 39/16*** | (2006.01) |
| ***B21B 23/00*** | (2006.01) |
| ***B21B 25/02*** | (2006.01) |
| *B21B 1/42* | (2006.01) |
| *B21B 13/20* | (2006.01) |
| *B21B 25/00* | (2006.01) |

(52) U.S. Cl.

CPC ..... *B21B 19/06* (2013.01); *B21B 23/00* (2013.01); *B21B 25/02* (2013.01); *B21B 1/42* (2013.01); *B21B 13/20* (2013.01); *B21B 25/00* (2013.01)

(58) Field of Classification Search

CPC ..... B21B 19/02; B21B 19/04; B21B 19/06; B21B 39/06; B21B 39/14; B21B 39/16; B21B 39/165

See application file for complete search history.

(56) References Cited

U.S. PATENT DOCUMENTS

| | | | | |
|---|---|---|---|---|
| 1,263,251 | A * | 4/1918 | Inshaw et al. | 72/250 |
| 2,048,925 | A * | 7/1936 | Diescher | 72/96 |
| 4,212,178 | A | 7/1980 | Bretschneider | |
| 4,501,134 | A | 2/1985 | Staat et al. | |
| 4,571,970 | A * | 2/1986 | Moltner et al. | 72/68 |
| 4,738,128 | A | 4/1988 | Staat | |

(Continued)

FOREIGN PATENT DOCUMENTS

| | | | |
|---|---|---|---|
| CN | 1328886 | A | 1/2002 |
| CN | 101657275 | A | 2/2010 |

(Continued)

OTHER PUBLICATIONS

German Office Action dated May 16, 2012 in German Application No. 10 2011 116 666.5 with English translation of the relevant parts.

(Continued)

*Primary Examiner* — Debra Sullivan
(74) *Attorney, Agent, or Firm* — Collard & Roe, P.C.

(57) ABSTRACT

A device for rolling of pipe blanks has a planetary cross-rolling mill, an advancing bed, a pipe blank feed, a pipe blank advancing unit that pushes the pipe blanks through the planetary cross-rolling mill, proceeding from the advancing bed, the unit having at least one advancing apparatus, and having a mandrel rod and a mandrel rod holder. The pipe blank feed has an axial pipe blank conveying unit that conveys a pipe blank axially into a readiness position, which is provided axially behind the mandrel rod holder. The advancing apparatus is disposed between the planetary cross-rolling mill and the mandrel rod holder, and has a slide.

7 Claims, 2 Drawing Sheets

(56) References Cited

U.S. PATENT DOCUMENTS

| | | | |
|---|---|---|---|
| 5,644,938 | A | 7/1997 | Moeltner et al. |
| 6,497,129 | B2 | 12/2002 | Pfeiffer et al. |
| 2010/0107713 | A1 | 5/2010 | Bindernagel et al. |

FOREIGN PATENT DOCUMENTS

| | | | |
|---|---|---|---|
| DE | 26 57 839 | | 6/1978 |
| DE | 3136381 | | 4/1983 |
| DE | 32 20 921 | | 12/1983 |
| DE | 35 33 119 | | 3/1987 |
| DE | 39 05 559 | A1 | 8/1990 |
| DE | 44 28 530 | | 2/1996 |
| DE | 101 26 411 | | 2/2005 |
| DE | 10 2007 014 079 | A1 | 9/2008 |

OTHER PUBLICATIONS

German Office Action dated Jul. 20, 2012 in German Application No. 10 2011 116 666.5 with English translation of the relevant parts.
European Search Report dated Nov. 2, 2012 in European Application No. 12004330.2 with English translation of the relevant parts.

* cited by examiner

DEVICE AND METHOD FOR ROLLING OF PIPE BLANKS

CROSS REFERENCE TO RELATED APPLICATIONS

Applicant claims priority under 35 U.S.C. §119 of German Application No. 10 2011 116 666.5 filed Jun. 7, 2011, the disclosure of which is incorporated by reference.

BACKGROUND OF THE INVENTION

1. Field of the Invention

The invention relates to a device for rolling of pipe blanks, having a planetary cross-rolling mill, having a pipe blank advancing unit that pushes the pipe blanks through the planetary cross-rolling mill, proceeding from the advancing bed, which unit has at least one advancing apparatus, having a mandrel rod and having a mandrel rod holder. The pipe blank feed has an axial pipe blank conveying unit that conveys a pipe blank axially into a readiness position, which is provided axially behind the mandrel rod holder. The advancing apparatus is disposed between the planetary cross-rolling mill and mandrel rod holder.

The invention also relates to a method for rolling pipe blanks in a planetary cross-rolling mill, in which the pipe blanks are conveyed to the planetary cross-rolling mill continuously, end to end, and two alternating advancing apparatuses push the pipe blanks into the planetary cross-rolling mill.

Furthermore, the invention relates to a method for rolling of pipe blanks in a planetary cross-rolling mill, in which the pipe blanks are conveyed to the planetary cross-rolling mill separate from one another.

2. The Prior Art

Devices and methods for pipe blank rolling are known from the state of the art concerning the production of pipes, in many different ways. For example, a method for rolling of pipe blanks in a planetary cross-rolling mill and a device for conveying pipe blanks into the planetary cross-rolling mill, with which the performance of a planetary cross-rolling mill can be increased, are described in German patent DE 101 26 411 B4.

For this purpose, it is proposed, in German patent DE 101 26 411 B4, that the feed of the pipe blanks to be rolled into the roll nip takes place continuously, end to end, and the pipe blank that follows the pipe blank situated in the roll nip, in each instance, is pushed forward with a rotation that corresponds to the rotation of the pipe loop end brought about by the torsion under the rolls. To implement this method, a device for conveying pipe blanks into the planetary cross-rolling mill is provided. In the planetary cross-rolling mill, each pipe blank can be rolled out by way of an interior tool that is held fixed in place in the roll nip. The device comprises a first and a second holding apparatus for the mandrel rod, disposed at an axial distance from the former, which holding apparatuses can be set radially against the mandrel rod independent of one another, as well as a first and a second advancing apparatus for the pipe blank, which can be set radially against the pipe blanks, independent of one another, and can be displaced with the latter, in the advancing direction and/or counter to it. Furthermore, a device for pushing a new pipe blank onto the rear end of the mandrel rod that is held in the rolling position, during rolling of a previous pipe blank, is provided. The movement of the holding apparatuses and that of the advancing apparatuses are coordinated with one another in such a manner that the rear end of the previous pipe blank and the front end of the subsequent pipe blank can be conveyed to the roll nip end to end, and the advancing direction has a clamping chuck mounted so as to rotate freely about the longitudinal pipe blank axis.

The restricted available stroke of the pipe blank advancing apparatuses, which are generally configured as advancing carriages that can move back and forth, is a disadvantage of the planetary cross-rolling mills that operate continuously, of the type stated. Because of the restricted stroke of the advancing carriages, a frequent change of the advancing carriages that are in engagement with each pipe blank takes place. This frequent change of the advancing carriages that are alternately in engagement with the pipe blank frequently leads to critical, non-uniform advancing movements, and this can have a disadvantageous effect on the quality of the finished rolled pipe. In this connection, a rolling process in copper rolling should be specifically mentioned, which is very sensitive in this regard and is therefore particularly susceptible to failure, in contrast to others.

In this regard, relatively great regulation effort with regard to the individual advancing carriages is required, in order to be able to undertake a hand-over from one advancing carriage to the other without sudden movements and without any negative influence on the rolling process.

However, this furthermore also leads to increased maintenance effort for such a pipe blank advancing apparatus, because changes or adaptations, for example with regard to friction behavior of "advancing carriage/pipe blank" make more frequent adjustments of the advancing carriages necessary.

SUMMARY OF THE INVENTION

It is therefore the task of the present invention to further develop devices and methods for rolling of pipe blanks of the type stated, with regard to a planetary cross-rolling mill, in such a way that the disadvantages stated above can be eliminated.

This object accomplished by a device for rolling of pipe blanks that comprises a planetary cross-rolling mill, an advancing bed, a pipe blank feed and a pipe blank advancing unit that pushes the pipe blanks through the planetary cross-rolling mill, proceeding from the advancing bed. The pipe blank advancing unit has at least one advancing apparatus, a mandrel rod and a mandrel rod holder. The pipe blank feed has an axial pipe blank conveying unit that conveys a pipe blank axially into a readiness position, which is provided axially behind the mandrel rod holder. The advancing apparatus is disposed between the planetary cross-rolling mill and the mandrel rod holder, and has a slide.

By means of the rolling device according to the invention, each pipe blank can be individually conveyed to the planetary cross-rolling mill, without sudden movements, in a rolling method in which the pipe blanks are continuously conveyed end to end to the advancing bed. This is possible in that each of the pipe blanks can be pushed into the planetary cross-rolling mill individually, by means of the slide, although the rolling device is continuously being charged with pipe blanks.

On the one hand, discontinuous method management of the planetary cross-rolling mill, in particular, is possible by means of the slide. Likewise, a very short reach of a rear advancing apparatus with continuous method management is possible, as will be explained in greater detail below.

The term "slide" describes, in the sense of the invention, any devices by means of which pipe blanks to be rolled can be individually rammed into a roll nip of a planetary cross-rolling mill, in that the slide engages on a pipe blank head-on and rams it in.

In one embodiment, the slide is radially displaceable, thereby advantageously allowing a reverse stroke of the advancing apparatus that directly precedes the planetary cross-rolling mill, even if a pipe blank is already situated in the readiness position.

Once the slide is radially displaced, the next pipe blank can be axially conveyed to the advancing bed and, in this connection, simultaneously be threaded onto or pushed onto the mandrel rod, thereby making it possible to cut any down time as compared to the state of the art, if applicable, at least in half, in advantageous manner, with appropriate method management.

Furthermore, the mandrel rod always remains in an inert gas atmosphere of the rolling device in the meantime, thereby also putting less thermal stress on the mandrel rod. As a result, the useful lifetime of the mandrel rod can be significantly increased.

In this connection, it is advantageous if a slide of a pipe blank ram of the present device has a pipe-like body, and the pipe-like body has a radial mandrel rod introduction opening that engages around the mandrel rod, particularly during the forward and/or backward stroke, so that the slide can perform its ramming function even if the mandrel rod projects beyond the rear end or the rear head of the pipe blank. A pipe-like body can be advantageously integrated into an axial processing segment or into an axial advancing segment, along which the pipe blanks are being conveyed or rammed, in the present case.

The slide can be permanently open radially as the result of the presence of the radial mandrel rod introduction opening, so that it can be removed from the mandrel rod radially or set onto the mandrel rod radially, without any problems.

It is understood that the present slide can be configured in many different ways. The slide can be implemented very simply, in terms of design, if it is configured in U shape. In this way, the radial mandrel rod introduction opening can be configured in a particularly simple manner, in terms of design, extending axially on the slide.

Radial displacement of the slide can be practiced advantageously, for example, if the present device has a radial support. If necessary, radial displaceability can also be implemented in another manner.

In order to always be able to orient the slide in a targeted manner, relative to the mandrel rod of the device, it is advantageous if the slide comprises a rotational drive.

Because conventional rolling devices and methods can be advantageously developed further by means of such a radially displaceable slide, the characteristics surrounding this radial displacement are inventive even without the other characteristics of the present invention.

Another embodiment of the invention comprises a device for rolling of pipe blanks that comprises a planetary cross-rolling mill, an advancing bed, a pipe blank feed, a pipe blank advancing unit that pushes the pipe blanks through the planetary cross-rolling mill, proceeding from the advancing bed, which unit has at least one advancing apparatus, a mandrel rod and a mandrel rod holder. The pipe blank feed has an axial pipe blank conveying unit that conveys a pipe blank axially into a readiness position, which is provided axially behind the mandrel rod holder. The advancing apparatus is disposed between planetary cross-rolling mill and mandrel rod holder, and the mandrel rod holder has at least two holding devices, of which a first is disposed behind and a second is disposed in front of the advancing apparatus.

In this connection, the stroke of the advancing apparatus can advantageously be dimensioned in such a manner that conveying of a subsequent pipe blank can be completed before the advancing apparatus reaches its end position. In this way, only one attack per pipe blank takes place.

Furthermore, a very long stroke of the advancing apparatus is possible in this connection, without having to extend the construction space of the advancing bed.

In another embodiment, the pipe blank advancing unit has at least one further advancing apparatus that is disposed behind the second holding device. In this way, continuous method management is possible, without problems.

The invention also comprises a method for rolling pipe blanks in a planetary cross-rolling mill, in which the pipe blanks are continuously conveyed to the planetary cross-rolling mill, end to end, and two alternating advancing apparatuses push the pipe blanks into the planetary cross-rolling mill. The two advancing apparatuses are operated with different stroke lengths.

Advantageously, a time available for recharging can be extended, on the basis of asymmetry of the stroke lengths of the two advancing apparatuses, thereby advantageously shortening the corresponding cycle times.

The invention also comprises a device for rolling of pipe blanks that comprises a planetary cross-rolling mill, an advancing bed, a pipe blank feed, a pipe blank advancing unit that pushes the pipe blank through the planetary cross-rolling mill, proceeding from the advancing bed, which unit has at least one advancing apparatus, a mandrel rod and a mandrel rod holder. The pipe blank feed has an axial pipe blank conveying unit that conveys a pipe blank axially into a readiness position, which is provided axially behind the mandrel rod holder. The advancing apparatus is disposed between the planetary cross-rolling mill and mandrel rod holder, and the advancing apparatus has an advancing path that is longer than half the length of the pipe blanks.

By means of such a long advancing path, the number of attacks of the advancing apparatus on the pipe blanks can be reduced or minimized, in an advantageous manner.

The invention also comprises a method for rolling of pipe blanks in a planetary cross-rolling mill, in which the pipe blanks are continuously conveyed to the planetary cross-rolling mill, end to end, whereby two alternating advancing apparatuses push the pipe blanks into the planetary cross-rolling mill, and the front one of the two advancing apparatuses rams the pipe blank.

Such ramming of each pipe blank preferably takes place with a slide such as that described in connection with the invention at other locations, for example. By means of ramming with such a slide, a rear advancing apparatus, if it is present, can engage farther back on the end of each the pipe blank, thereby also making it possible to advantageously reduce the number of attacks.

In an alternative embodiment, the method comprises rolling of pipe blanks in a planetary cross-rolling mill, in which the pipe blanks are conveyed to the planetary cross-rolling mill separate from one another, and the mandrel rod can always remain in its advancing bed position and thus also in the inert gas atmosphere of the rolling device. In this way, the stress on the mandrel rod can be significantly decreased. Furthermore, the pipe blanks can pass through the advancing bed and be pushed to the planetary cross-rolling mill more quickly, with appropriate method management otherwise.

According to another aspect, the task of the invention is also accomplished by a method for rolling of pipe blanks in a planetary cross-rolling mill, in which the pipe blanks are conveyed to the planetary cross-rolling mill separate from one another and the pipe blank is axially conveyed onto an advancing bed. Axial conveying of the pipe blanks can be brought about significantly more advantageously, in terms of process technology and time, than radial conveying, which is practiced in known, discontinuous rolling methods.

Furthermore, it is advantageous if an advancing apparatus passes through a back stroke past the pipe blank, while the pipe blank is being axially conveyed onto the advancing bed.

Advantageously, the advancing apparatus can be simultaneously moved back, thereby making it possible to achieve a further time saving with regard to the present rolling method.

In another embodiment, the invention comprises a method for rolling of pipe blanks in a planetary cross-rolling mill, in which the pipe blanks are conveyed to the planetary cross-rolling mill separate from one another, and a mandrel rod disposed in the pipe blank is held by a mandrel rod holder during rolling. In this way, a significantly better rolling result can be achieved.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
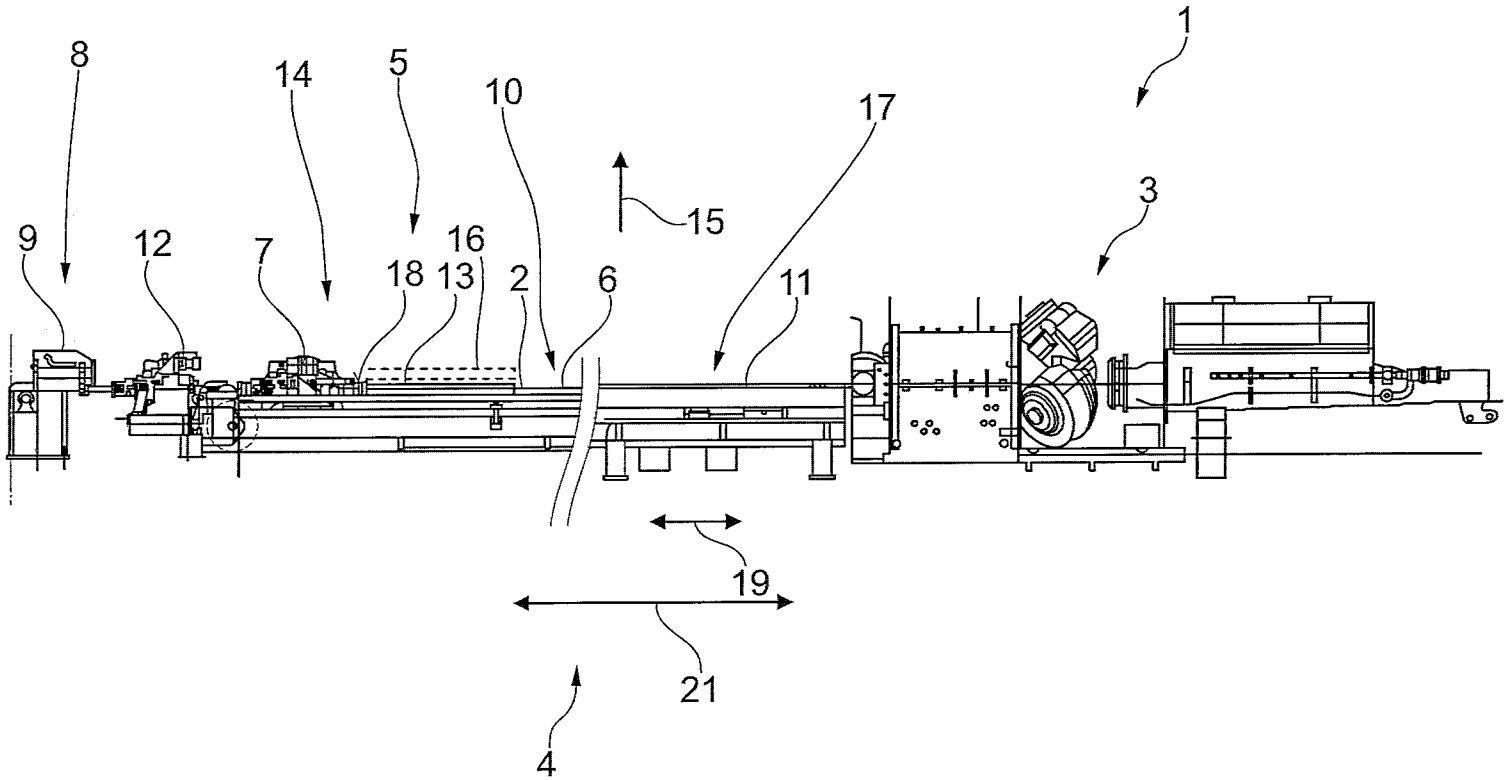
FIG. 1 shows schematically, a side view of a first exemplary embodiment of a rolling device comprising a planetary cross-rolling mill and a single advancing apparatus having a slide.

Referring now in detail to the drawings, a device 1 for rolling of pipe blanks 2 shown in FIG. 1 has a planetary cross-rolling mill 3, by means of which the pipe blanks 2 are rolled, one after the other, to produce finished pipes (not numbered here).

An advancing bed 4 is situated in front of the planetary cross-rolling mill 3, which bed comprises a pipe blank advancing unit 5 by means of which the pipe blanks 2 are pushed or rammed toward the planetary cross-rolling mill 3, individually and axially, along an axial processing segment 6.

The pipe blank advancing unit 5 is equipped, for this purpose, in this exemplary embodiment, with a single advancing apparatus V.

A pipe blank feed B having an axial pipe blank conveying unit 9 is placed in front of the advancing bed 4, proceeding axially from the planetary cross-rolling mill 3.

Each pipe blank 2 is axially conveyed to the rolling device 1 particularly by means of the axial pipe blank conveying unit 9, and, in this connection, is conveyed into a readiness position 10 of the rolling device 1.

The advancing bed 4 furthermore has a mandrel rod 11 and a mandrel rod holder 12 assigned to it. The readiness position 10 is situated axially behind the mandrel rod holder 12, whereby the advancing apparatus 7 is situated between the planetary cross-rolling mill 3 and the mandrel rod holder 12.

Furthermore, the advancing apparatus 7 is provided with a slide 13 of a pipe blank ram 14, by means of which each individual one of the pipe blanks 2 is successively and individually pushed or rammed toward the planetary cross-rolling mill 3. In this regard, this is a discontinuous charging process.

Advantageously, the slide 13 can be displaced from the axial processing segment 6, radially 15 into a waiting position 16, so that a pipe blank 2 can be moved out of the readiness position 10 into a rolling pre-position 17.

In this regard, the pipe blank ram 14 can be opened in such a manner that one of the pipe blanks 2 can be pushed past the slide 13, although the advancing apparatus 7 continues to surround the mandrel rod 11.

In this way, in this exemplary embodiment, a charging time of a pipe blank 2 can advantageously be reduced by at least half of conventional charging times, which can often amount to as much as 3 min in the case of pipe blank lengths of up to 21 m.

The slide 13 has a pipe-like body 18 that has a radial mandrel rod introduction opening (not shown here) in the direction of its longitudinal axial expanse 19.

For radial displacement of the slide 13, in this exemplary embodiment, a radial drive is provided on the advancing apparatus 7, which drive can radially displace the slide 13, accordingly.

The advancing apparatus 7 is furthermore equipped with a rotational drive, not shown here, to be able to rotate the slide 13 into a corresponding displacement position for radial displacement, in which position the mandrel rod introduction opening is directed downward.

In an advantageous manner, a displacement path 21 along the axial processing segment 6 can be implemented with the advancing apparatus 7, which path is longer than half the length (not numbered here) of one of the pipe blanks 2, and specifically amounts to at least the length of one of the pipe blanks 2. In this way, it is particularly possible to do without further advancing apparatuses, because the advance can be performed with this single advancing apparatus 7, which particularly brings about a very uniform drive for the pipe blanks 2, so that a correspondingly good rolling result can also be implemented.

The mandrel rod 11 can remain in front of the planetary cross-rolling mill 3 because of the mandrel rod holder 12, in the corresponding inert gas atmosphere, and this particularly relieves stress on the mandrel rod 11 and also benefits the work speed.

Figure 2:
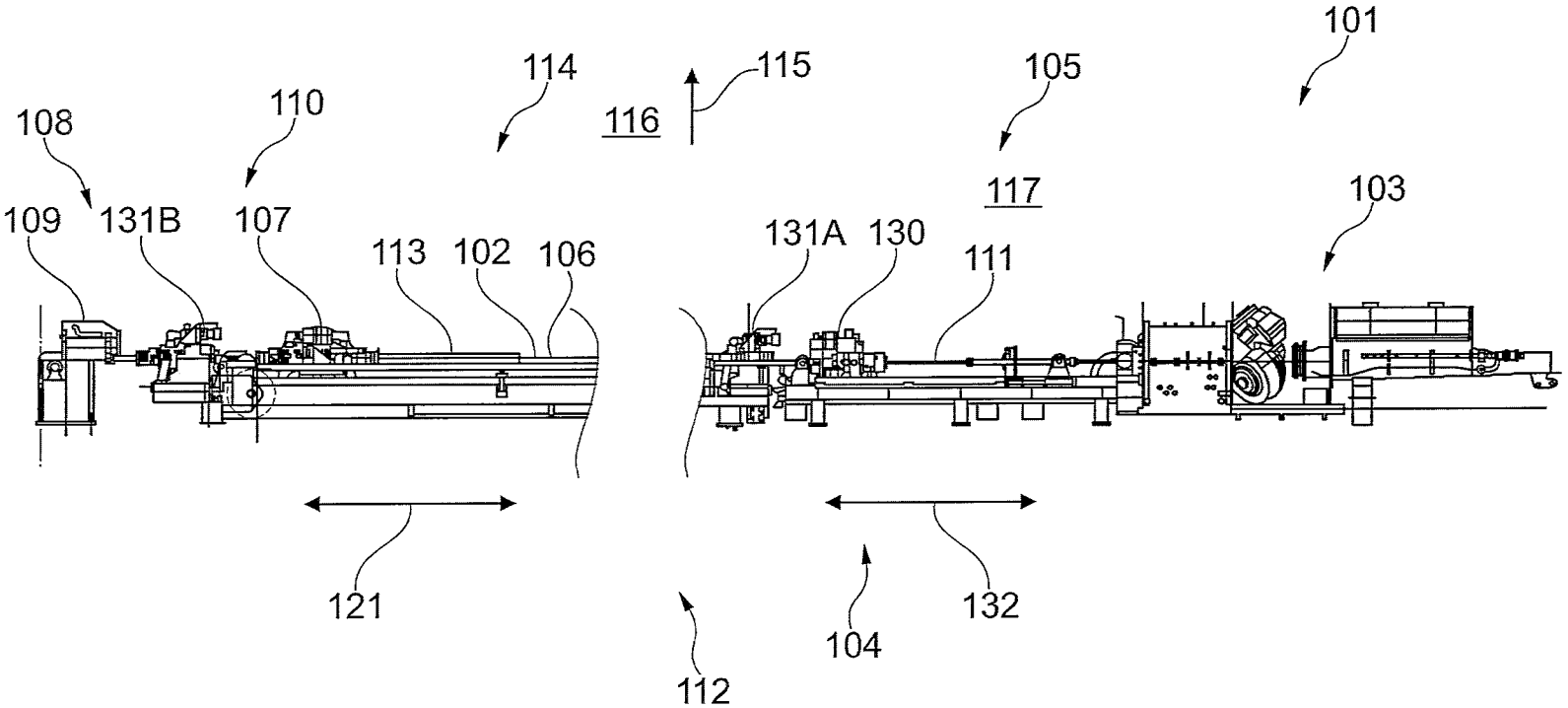
FIG. 2 shows schematically, a side view of another exemplary embodiment of a rolling device comprising a planetary cross-rolling mill and a front advancing apparatus having a slide, as well as a rear advancing apparatus, by means of which pipe blanks are alternately pushed along an axial processing segment.

The rolling device 101 shown in FIG. 2 has essentially the same structure as the rolling device 1 from FIG. 1; however, it is supplemented with a rear advancing apparatus 130 and with a second mandrel rod holder in the form of a first holding device 131A for the mandrel rod 111.

Otherwise, the rolling device 101 also has a planetary cross-rolling mill 103 that has an advancing bed 104 with a pipe blank advancing unit 105 comprising a front advancing apparatus 107 and the rear advancing apparatus 130 assigned to it.

A pipe blank feed 108 having an axial pipe blank conveying unit 109 is set up proceeding from the planetary cross-rolling mill 103, axially behind the advancing bed 104.

Each one of the pipe blanks 102 can be conveyed into a readiness position 110 by means of the axial pipe blank conveying unit 109, in order to subsequently be pushed along an axial processing segment 106 by means of the two advancing apparatuses 107 and 130, alternately, in the direction of the planetary cross-rolling mill 103.

Likewise, the mandrel rod 111 is held in position by means of a mandrel rod holder 112 comprising the first holding device 131A and a second holding device 131B, whereby the holding devices 131A and 131B can be opened if a pipe blank 102 runs past them, because then the other of the two holding devices 131A and 131E still holds the mandrel rod 111.

In this embodiment, as well, the front advancing apparatus 107 comprises a pipe blank ram 114 having a slide 113, which can be displaced radially 115 out of the axial processing segment 106 into a waiting position 116, in order to then be able to move one of the pipe blanks 102 past the slide 113 into a rolling pre-position 117. The rear advancing apparatus 130 is then activated for the last part of the pipe blank 102, which then has already run through the rolling device 101, for the most part.

In this further exemplary embodiment, the pipe blanks 102 are conveyed to the advancing bed 104 by means of the axial pipe blank conveying unit 109, and are driven further in the direction of the rear advancing apparatus 130 by means of the front advancing apparatus 107, end to end. This rear advancing apparatus 130 grips the pipe blank 102 and pushes it through the planetary cross-rolling mill 103. The pipe blanks 102 are rammed into the planetary cross-rolling mill 103 by the front advancing apparatus 107, whereby if necessary, a pipe blank 102 rammed by the front advancing apparatus 107 or pushed by the rear advancing apparatus 130 can also ram a pipe blank 102 that lies behind it.

In this regard, we have here a combination of pushing and ramming. In advantageous manner, a continuous charging process can be implemented in this way.

The pipe blanks 102 are therefore conveyed to the planetary cross-rolling mill 103 alternately by means of the two advancing apparatuses 107 and 130, and the two advancing apparatuses 107 and 130 have different stroke lengths. The front advancing apparatus 107 has a front advancing path 121 that is longer than half the length of one of the pipe blanks 102.

In contrast, the rear advancing apparatus 130 has a different rear advancing path 132. Because of the different advancing paths 121 and 132, a time available for axial conveying or axial recharging of a subsequent pipe blank 102 can advantageously be lengthened.

It is understood that the exemplary embodiments explained above are merely first embodiments of the rolling device according to the invention. In this regard, the invention is not restricted to these first exemplary embodiments.

REFERENCE SYMBOL LIST

1 rolling device
2 pipe blanks
3 planetary cross-rolling mill
4 advancing bed
5 pipe blank advancing unit
6 axial processing segment
7 advancing apparatus
8 pipe blank feed
9 axial pipe blank conveying unit
10 readiness position
11 mandrel rod
12 mandrel rod holder
13 slide
14 pipe blank ram
15 radial(ly)
16 waiting position
17 rolling pre-position
18 pipe-like body
19 axial longitudinal expanse
21 advancing path
101 rolling device
102 pipe blank
103 planetary cross-rolling mill
104 advancing bed
105 pipe blank advancing unit
106 axial processing segment
107 front advancing apparatus
108 pipe blank feed
109 axial pipe blank conveying unit
110 readiness position
111 mandrel rod
112 mandrel rod holder
113 slide
114 pipe blank ram
115 radial
116 waiting position
117 rolling pre-position
121 front advancing path
130 rear advancing apparatus
131A first holding device
131B second holding device
132 rear advancement path

What is claimed is:

1. A device for rolling of pipe blanks, comprising:
a planetary cross-rolling mill;
an advancing bed comprising:
a pipe blank advancing unit that pushes the pipe blanks from the advancing bed through the planetary cross-rolling mill, said unit having at least one advancing apparatus;
a mandrel rod; and
a mandrel rod holder; and
a pipe blank feed;
wherein the pipe blank feed has an axial pipe blank conveying unit that conveys a pipe blank axially into a readiness position, said pipe blank conveying unit being provided axially behind the mandrel rod holder,
wherein the advancing apparatus is disposed between the planetary cross-rolling mill and the mandrel rod holder, and
wherein the advancing apparatus has a radially displaceable pusher configured for directly pushing each pipe blank toward the planetary cross-rolling mill, wherein the pusher engages each pipe blank head-on and rams the pipe blank toward the planetary cross rolling mill.

2. The device according to claim 1, wherein the pusher comprises a rotational drive.

3. A device for rolling of pipe blanks, comprising:
a planetary cross-rolling mill;
an advancing bed comprising:
a pipe blank advancing unit that directly pushes the pipe blanks from the advancing bed through the planetary cross-rolling mill, said unit having at least one advancing apparatus;
a mandrel rod; and a mandrel rod holder; and a pipe blank feed;

wherein the pipe blank feed has an axial pipe blank conveying unit that conveys a pipe blank axially into a readiness position, said pipe blank conveying unit being provided axially behind the mandrel rod holder, wherein the advancing apparatus is disposed between the planetary cross-rolling mill and the mandrel rod holder, wherein the advancing apparatus has an advancing path that is longer than half the length of the pipe blanks, wherein the advancing apparatus has a radially displaceable pusher configured for directly pushing the each pipe blank toward the planetary cross-rolling mill, mill, and wherein the pusher engages each pipe blank head-on and rams the pipe blank toward the planetary cross rolling mill.

4. A method for rolling of pipe blanks in a planetary cross-rolling mill, comprising conveying the pipe blanks to the planetary cross-rolling mill separate from one another, and rolling the pipe blanks in the planetary cross-rolling mill, wherein each pipe blank is pushed over a mandrel rod before being rolled, wherein each pipe blank is axially conveyed onto an advancing bed, wherein the pipe blanks are continuously conveyed to the planetary cross-rolling mill, end to end, wherein the pipe blanks are pushed by a radially displaceable pusher of two advancing apparatuses directly into the planetary cross rolling mill, and wherein the pusher engages each pipe blank head-on and rams the pipe blank toward the planetary cross rolling mill.

5. The method according to claim 4, wherein the two advancing apparatuses are operated with different stroke lengths from each other.

6. The method according to claim 4, wherein a front one of the two advancing apparatuses rams the pipe blank.

7. The method according to claim 4, wherein one of the advancing apparatuses passes past the pipe blank through a back stroke, while the pipe blank is being axially conveyed onto the advancing bed.

* * * * *